United States Patent [19]

Clements et al.

[11] 4,354,702

[45] Oct. 19, 1982

[54] WOOD FIRE FEEDER

[76] Inventors: Ray Clements, 110 Ray Ave.; Morris Clements, 201 Ray Ave., both of Rainsville, Ala. 35986

[21] Appl. No.: 182,397

[22] Filed: Aug. 26, 1980

[51] Int. Cl.[3] ..... A47J 49/00

[52] U.S. Cl. ..... 294/9

[58] Field of Search ..... 294/9–11, 294/14–17, 26, 27 R, 32, 49, 50.6, 54, 55, 55.5, 57, 58, 137; 16/110 R

[56] References Cited

U.S. PATENT DOCUMENTS

| | | | |
|---|---|---|---|
| 275,130 | 4/1883 | Brown | 294/55.5 X |
| 539,851 | 5/1895 | Bedford | 294/15 X |
| 1,453,188 | 4/1923 | Ruppe | 294/58 |
| 2,416,414 | 2/1947 | Spencer | 294/58 |
| 2,629,624 | 2/1953 | Nelles | 294/57 |
| 3,136,574 | 6/1964 | Pasquale | 294/58 X |
| 3,384,407 | 5/1968 | Thrash | 294/16 |
| 4,194,778 | 3/1980 | Hodnett | 294/9 |
| 4,248,464 | 2/1981 | Cross | 294/9 |

*Primary Examiner*—Johnny D. Cherry
*Attorney, Agent, or Firm*—Harvey B. Jacobson

[57] ABSTRACT

A loading device for manually inserting wood logs into a wood fire stove or fireplace comprises a load support surface and a pair of spaced handle members placed behind the load support, each of the handle members being inclined upwardly with respect to the load support. The load support surface includes two parallel holding members which are spaced to either support the log for loading from one end or for loading the entire body portion of the log at once. The handle members are preferably inverted U-shaped members inclined upwardly from a pair of parallel and spaced frame members secured to the load support.

3 Claims, 4 Drawing Figures

WOOD FIRE FEEDER

BACKGROUND OF THE INVENTION

1. Field of the Invention

This invention relates to a device for loading wood logs into a wood-burning stove or fireplace. In particular, the device comprises a load support means and unique handle means providing easy loading of logs into the wood-burning area of the stove, fireplace, etc.

Recently, with the increase in the cost of domestic heating oil, there has been renewed interest in domestic heating and cooking with the use of wood-burning stoves and fireplaces. With the increased use of wood to produce heat for domestic purposes, has come a need for feeding wood fires easily and safely without injury and without damaging the wood-burning device or disturbing the wood fuel already in place. The present invention is a loading device which enables such safe and easy loading of logs into a wood-burning device. Due to its light weight and unique construction, any individual can lift and load a wood log into a wood-burning stove or fireplace easily and safely.

2. Disclosure Statement

The present invention provides for a unique arrangement of a load support surface and a handle means which enables the easy lifting and loading of a wood log. An example of a loading device utilizing a load support surface comprising two parallel spaced members is disclosed in U.S. Pat. No. 1,420,546, issued June 20, 1922, to Hermelink et al, for lifting barrels. The loading device of this patent includes transverse flexible elements located between the spaced members for respective engagement with the opposite sides of the barrel or receptacle adjacent respectively to the opposite ends thereof. A tool for cleaning furnace grates is disclosed in U.S. Pat. No. 2,099,355, issued Nov. 16, 1937, to Teorell, in which a blade segment is pushed into the furnace by means of a straight pushing handle, the tool further including a crank rocking handle for causing the blade segment to oscillate about the longitudinal axis of the pushing handle. Neither of these two patents, however, discloses the loading device of the present invention including the unique arrangement of the load support surface and the pair of spaced upwardly inclined handle members. U.S. Pat. No. 2,575,794, issued Nov. 20, 1951, to Chauncey, discloses a fork for lifting baled hay comprising the conventional elongated spaced tines and a unique handle means comprising one handle placed directly behind the tines and another handle connected to an L-shaped member which extends over and between the tines, the second handle member inclined upwardly and extending in the direction of the pointed ends of the tines. While this patent discloses the use of two handle members for supporting a load, the configuration of the handle members would not provide for the easy and safe loading of a log into a wood-burning fire as does the present invention since the second handle member would certainly limit the size of log which could be handled and its position near the front of the load support means could cause serious injury to persons utilizing this device to load wood logs into a fire.

SUMMARY OF THE INVENTION

It is a primary object of the present invention to provide a device which will enable the loading of wood logs into a wood-burning stove or fireplace.

Another object of the present invention is to provide a device for loading wood logs into a wood-burning stove or fireplace which is easy to handle and provides for the safe loading of wood logs and is so designed as to prevent the burning of hands and enables the hands to remain clean during loading.

Another object of the present invention is to provide a wood log loading device which enables the easy manipulation of wood logs into a wood fire without damaging the wood-burning furnace or fireplace and which reduces the disturbance of the wood logs already in place.

Further still, another object of the present invention is to provide a wood log loading device which is strong enough to lift wood logs, including large green wood, without damage to the device and yet is lightweight and can be designed to suit the individual.

Still yet another object of the present invention is to provide a wood log loading device including a log support portion which can be designed to either support a log along its length or at each end to provide for loading a wood log from its end in a longitudinal direction or in a transverse direction, respectively.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
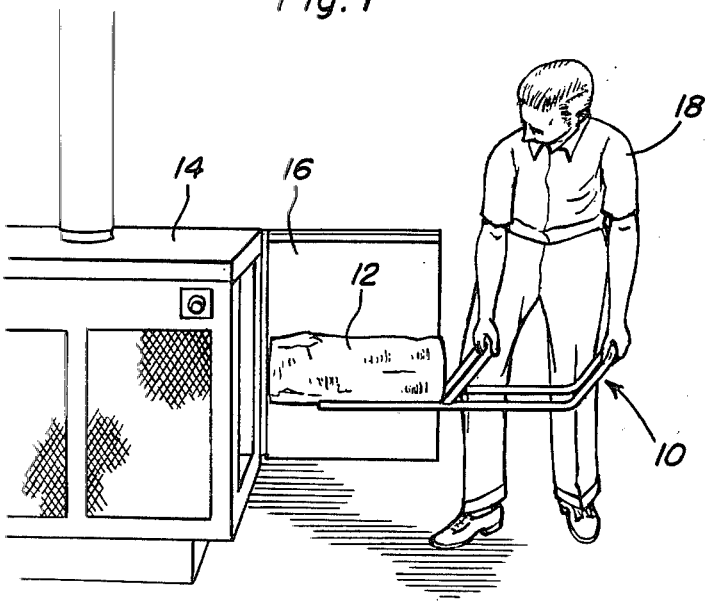
FIG. 1 is a perspective view illustrating the use of one form of the wood log loading device of the present invention to load a wood log into a wood-burning stove.
Figure 2:
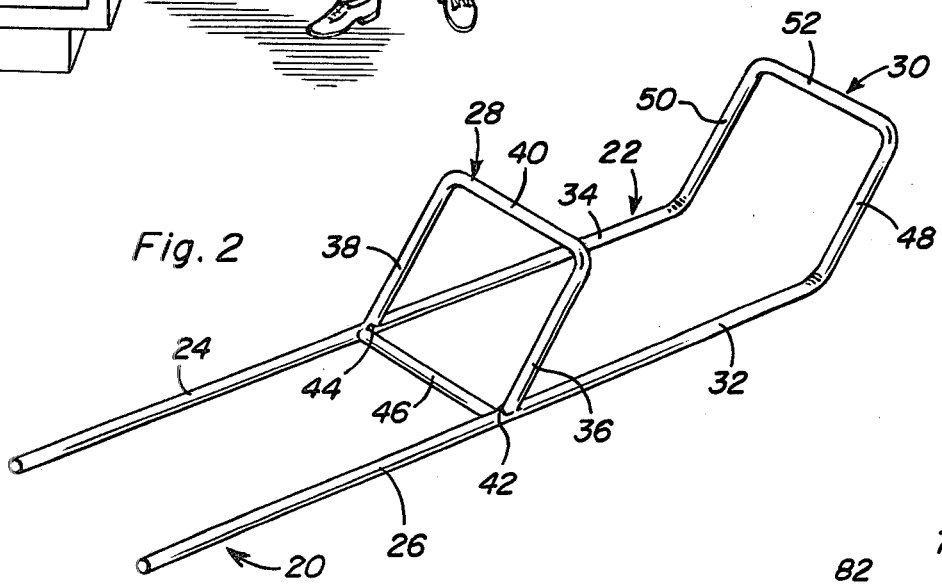
FIG. 2 is a perspective view illustrating one form of the wood log loading device of the present invention.

In FIGS. 1 and 2, there is shown one embodiment of the wood log loading device of the present invention designated generally by reference numeral 10. As can be seen in FIG. 1, loading device 10 supports a log 12 along a substantial part of its length and is loaded into a conventional wood-burning stove or heater 14 end to end longitudinally through side door 16 of heater 14 by individual 18.

Wood log loading device 10 is comprised of load support portion 20 and handle portion 22. Load support portion 20 is formed of two elongated parallel spaced members 24 and 26 which preferably contain no sharp edges, such as a pipe section of relatively small diameter. Members 24 and 26 are spaced enough distance apart to support a log from the bottom thereof when the log is placed in a longitudinal direction parallel with the spaced members as shown in FIG. 1. The length of each member 24 and 26 can be varied but should support at least about ¾ of the log to provide safe loading without dropping the log thereby preventing possible injury or disturbance of the logs already in place in the wood-burning stove 14. Handle portion 22 provides for the safe and easy lifting of loading device 10 by user 18 and comprises a pair of handle members 28 and 30. As can be seen in FIG. 2, handle members 28 and 30 are inclined upwardly from load support portion 20 and are supported on spaced parallel frame members 32 and 34. Handle member 28 is positioned directly behind load support portion 20 and for most instances will provide a stop for the log being loaded, see FIG. 1 in which an end of log 12 is placed against handle member 28. Handle member 28 is an inverted U-shaped member including parallel side members 36 and 38 and top gripping member 40 placed between side members 36 and 38. Side members 36 and 38 are secured to frame members 32 and 34, respectively, by a strong adhesive or by welding placed at the attachment joints 42 and 44. Since handle member 28 is placed at the maximum leverage point of loading device 10, a cross support 46 extends between frame members 32 and 34 at or near joints 42 and 44 to provide increased strength to loading device 10 during use. The space between handle members 28 and 30 is provided for the purpose of obtaining the greatest amount of load lifting leverage for individual users. Handle member 30 is equivalent in form to handle member 28 and is an inverted U-shaped member including side members 48 and 50 and top gripping member 52 placed therebetween.

Each handle member 28 and 30 is inclined upwardly in the opposite direction of load support portion 20. Side members 36 and 38 of handle member 28 and side members 48 and 50 of handle 30 preferably form about a 45° angle with the horizontal plane of frame members 32 and 34. At a 45° angle, the proper leverage to easily lift and load log 12 into stove 14 is provided. An angle from between about 45° to 90° between the side members of handle members 28 and 30 and frame members 32 and 34 provide varying degrees of leverage and can be chosen upon user preference.

A preferred form of the invention provides for a log loading device 10 comprising an elongated U-shaped member in which side members 24 and 26 of load support portion 20, frame members 32 and 34 of handle portion 22 and side members 48 and 50 and top gripping member 52 of handle member 30 are formed into a single unitary construction. Handle member 28 and cross support 46 are welded or otherwise attached to the side members of the unitary frame. Handle members 28 and 30 are each formed from an inverted unitary U-shaped construction. In the preferred embodiment, side members 36, 38 and top gripping member 40 of handle member 28 and side members 48, 50 and gripping member 52 of handle member 30 are each six inches and form a 45° angle with the support frame. Each side of loading device 10 including handle portion 22 and load support portion 20 are 32 inches and are formed of one-half inch metal pipe. Of course, these dimensions can vary according to use and should not be so construed as to limit the invention to these specific dimensions. Log loading device 10 is preferably formed of lightweight metal, such as aluminum, but could be formed of other metals such as a lightweight steel. Further, any other materials which have the strength to support wood logs can be used, including high strength plastics.

Figure 3:
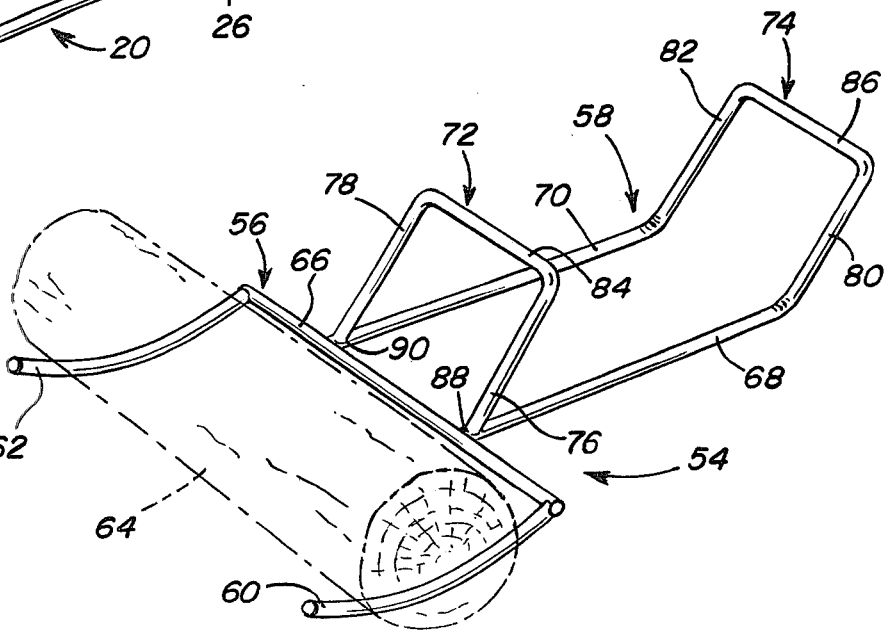
FIG. 3 is a perspective view illustrating a second embodiment of the wood log loading device.

An alternative to log loading device 10 which loads logs from a single end into a wood-burning stove or fireplace as shown in FIG. 1 is log loading device 54 which is used to load logs in the transverse direction, FIG. 3. Log loading device 54 comprises a load support portion 56 which can support a wood log adjacent both ends thereof in a direction perpendicular to the longitudinal direction of handle portion 58. Load support portion 56 comprises spaced parallel support members 60 and 62 which are curved to support and hold a log 64 therebetween, support members 60 and 62 supporting the bottom of log 64 as shown. Support members 60 and 62 are secured to opposite ends of cross support 66 which in turn is secured to frame members 68 and 70 of handle portion 58. Handle portion 58 is substantially equivalent to handle portion 22 of log loading device 10 and includes spaced handle members 72 and 74 formed of an inverted U-shape equivalent to handle members 28 and 30. Side members 76 and 78 of handle member 72 and side members 80 and 82 of handle member 74 form approximately a 45° angle with a parallel plane of frame members 68 and 70, equivalent to the angle formed by handle members 28 and 30 of log loading device 10. Each handle member 72 and 74 includes a gripping portion 84 and 86, respectively. Preferably, frame members 68 and 70 and handle member 74 are formed of a unitary construction with handle member 72 being attached such as by welding to frame members 68 and 70 at joints 88 and 90. The length of cross support 66 and the space between load support member 60 and 62 should be such so as to enclose most of log 64 to provide for safe and ease of handling. Log loading device 54 is a front loading device, primarily used for fireplaces and front loading wood-burning stoves, while log loading device 10 is primarily a side loading device. Log loading device 54 can be constructed of the same materials as mentioned for loading device 10.

Figure 4:
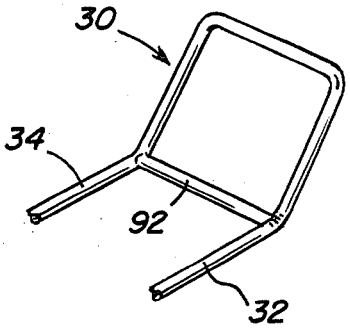
FIG. 4 is a fragmentary perspective view of an alternative form of handle member for use in either of the loading devices illustrated in FIGS. 2 and 3.

In FIG. 4 there is shown an alternative for handle members 30 and 74 of log loading device 10 and 54, respectively. In this alternative embodiment, a further cross piece 92 is added between the frame members such as 32 and 34 to provide added strength and added leverage weight to the end of each loading device. Cross support 92 can be welded or otherwise similarly attached to the frame members.

As can be determined from FIG. 1, log loading device 10 as well as log loading device 54 provides for the safe loading of logs into a wood-burning stove 14. The inclined angle of each handle member away from the load support portion prevents the hands from being burned since they are spaced away from the log surface and need not be placed over the fire for loading the log thereon. Further, since the log is supported by the load support portion, there is no need to lift the log by the hands of the user preventing the hands from becoming dirty, scratched or otherwise injured by contact with the surface of the log. By lifting gripping portions 52 or 86, the log will gently slide off load support portions 20 and 56, respectively, onto the wood-burning fire. The leverage provided by the dual handle members greatly increases the ease of handling large heavy logs which can now be safely handled for use by the loading devices of the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device for lifting a log and inserting it endwise into a stove or other wood burning appliance comprising a pair of straight, parallel, elongated, rigid members spaced apart a distance enabling the free ends to be received through the door opening of a stove and with the members engaging the external surface of a log along spaced longitudinal surfaces on opposite sides of the center of the lower surface of the log, a transverse member rigidly connecting said elongated members adjacent the center thereof and disposed in the same horizontal plane to retain the elongated members in parallel relation and forming a stop to limit movement of the log onto the elongated members from the free ends thereof, each of said elongated members including an upwardly extending member at the end thereof remote from the free end thereof, said upwardly extending members being rigid with respect to said elongated members, a transverse member rigidly interconnecting the upper ends of the upwardly extending members to maintain the elongated members in parallel relation and forming a straight handle extending in a horizontal plane parallel to the horizontal plane of the elongated members to enable the handle to be grasped at any point along its length, and a centrally disposed handle adjacent the center of said elongated members and rigidly supported in relation thereto and including a straight rigid member parallel to said straight handle and disposed in substantially the same horizontal plane, said straight rigid member having the ends thereof rigidly connected to said elongated members by a pair of parallel rigid members extending upwardly from said elongated members at the ends of the transverse member forming a log stop, said upstanding members at the ends of the log stop being inclined away from the free ends of the elongated members to enable a person to grasp the centrally disposed handle with their hand spaced from the end of the log with lifting force applied to the centrally disposed handle being above a substantial portion of the log to reduce the tendency of the log causing the device to tilt about a longitudinal axis when being lifted.

2. The structure as defined in claim 1 wherein said upwardly extending members remote from the free end of the elongated members are inclined and parallel to the upstanding members at the ends of the log stop, and a transverse member rigidly interconnecting the ends of the elongated members remote from the free ends and disposed in the same horizontal plane as the elongated members.

3. A device for lifting a log and inserting it into a fireplace, stove or other wood burning appliance comprising a pair of parallel, elongated, rigid members spaced apart a distance enabling the free ends to be received through the opening of a fireplace or stove and with the members engaging the external surface of a log at longitudinally spaced surfaces, a transverse member rigidly connecting said elongated members between the free ends and the remainder thereof and disposed in the same horizontal plane to retain the elongated members in parallel relation and forming a stop to limit movement of the log on the free ends of the elongated members, each of said elongated members including an upwardly extending member at the end thereof remote from the free ends thereof, said upwardly extending members being rigid with respect to said elongated members, a transverse member rigidly interconnecting the upper ends of the upwardly extending members to maintain the elongated members in parallel relation and forming a straight handle extending in a horizontal plane parallel to the horizontal plane of the elongated members to enable the handle to be grasped at any point along its length, and a centrally disposed handle adjacent the free ends of said elongated members and rigidly supported in relation thereto and including a straight rigid member parallel to said straight handle and disposed in substantially the same horizontal plane, said straight rigid member having the ends thereof rigidly connected to said elongated members by a pair of parallel rigid members extending upwardly from said elongated members at the transverse member forming the log stop, said upstanding members at the log stop being inclined away from the free ends of the elongated members to enable a person to grasp the centrally disposed handle with their hand spaced from the log with lifting force applied to the centrally disposed handle being above a substantial portion of the log to reduce the tendency of the log causing the device to tilt about a longitudinal axis when being lifted, said free ends of the elongated rigid members being arcuate and spaced apart a distance greater than the remainder of the elongated rigid members, said transverse member at the log stop extending laterally beyond the remainder of the elongated members and rigidly interconnecting the free ends and the remainder of the elongated member.

* * * * *